US011536068B2

(12) United States Patent
Girotto et al.

(10) Patent No.: US 11,536,068 B2
(45) Date of Patent: Dec. 27, 2022

(54) FURNITURE ITEM WITH SLIDING FOLDABLE-AWAY LEAVES

(71) Applicant: BORTOLUZZI SISTEMI S.P.A, Belluno (IT)

(72) Inventors: Adriano Girotto, Belluno (IT); Daniele Sbardella, Belluno (IT); Rodolfo Dal Castel, Belluno (IT)

(73) Assignee: BORTOLUZZI SISTEMI S.P.A., Belluno (IT)

( * ) Notice: Subject to any disclaimer, the term of this patent is extended or adjusted under 35 U.S.C. 154(b) by 431 days.

(21) Appl. No.: 16/630,526

(22) PCT Filed: Jul. 11, 2018

(86) PCT No.: PCT/IB2018/055094

§ 371 (c)(1),
(2) Date: Jan. 13, 2020

(87) PCT Pub. No.: WO2019/012435

PCT Pub. Date: Jan. 17, 2019

(65) Prior Publication Data

US 2020/0157867 A1 May 21, 2020

(30) Foreign Application Priority Data

Jul. 12, 2017 (IT) ..... 102017000078326

(51) Int. Cl.

| | |
|---|---|
| ***E05D 15/26*** | (2006.01) |
| ***E05D 15/58*** | (2006.01) |
| ***E05F 1/16*** | (2006.01) |

(52) U.S. Cl.
CPC ..... *E05D 15/26* (2013.01); *E05D 15/58* (2013.01); *E05F 1/16* (2013.01); *E05Y 2201/62* (2013.01); *E05Y 2900/212* (2013.01)

(58) Field of Classification Search
CPC ..... E05D 15/26; E05D 15/264; E05D 15/58; E05Y 2201/62; E05Y 2900/212; E05F 1/16
See application file for complete search history.

(56) References Cited

U.S. PATENT DOCUMENTS

| | | | | |
|---|---|---|---|---|
| 5,131,449 | A * | 7/1992 | Winn | E05D 15/264 160/214 |
| 10,753,133 | B2 * | 8/2020 | Kohlweiss | E05F 1/1041 |
| 2006/0255699 | A1 * | 11/2006 | Punzel | A47B 81/005 312/217 |
| 2007/0159037 | A1 * | 7/2007 | Hoffman | E05D 15/58 312/322 |
| 2013/0232878 | A1 * | 9/2013 | Bortoluzzi | E05D 15/58 49/252 |

(Continued)

FOREIGN PATENT DOCUMENTS

| | | |
|---|---|---|
| EP | 0433726 A1 | 6/1991 |
| EP | 2740870 A1 | 6/2014 |

*Primary Examiner* — Daniel J Rohrhoff
(74) *Attorney, Agent, or Firm* — Mark M. Friedman

(57) ABSTRACT

A furniture item (MC) is described comprising a body defining a compartment (20) with a front opening, a leaf (32) which is slidable and oscillating to close the front opening, and an L-shaped guide (50) comprising two linear segments (52, 54) connected together. The leaf can be moved by a command member (60) translatable parallelly to—and along—said outer side.

20 Claims, 5 Drawing Sheets

(56) References Cited

U.S. PATENT DOCUMENTS

| | | | | |
|---|---|---|---|---|
| 2014/0150208 | A1* | 6/2014 | Haab | E05D 13/00 16/86.2 |
| 2015/0008811 | A1* | 1/2015 | Ishii | E06B 3/5045 312/322 |
| 2018/0128032 | A1* | 5/2018 | Karle | E05F 15/635 |
| 2021/0262260 | A1* | 8/2021 | Duer | E05D 15/264 |
| 2022/0074250 | A1* | 3/2022 | Duer | E05D 15/264 |

* cited by examiner

Dout
Din
V
X
X2
20
22
26
26r
28
30
32
40
42
44
52
54
56
60
62
64
70

MC2
MC3
60
80
82
90
92
94

FURNITURE ITEM WITH SLIDING FOLDABLE-AWAY LEAVES

The invention refers to a furniture item with sliding and swinging leaves so as to be folded away, in particular equipped with a compartment closable by the leaves.

Many pieces of furniture are equipped with sliding and folding leafs to allow a reduction of the dimensions of the leaves themselves in the opening position, thus avoiding the disadvantages of hinged leafs. FIGS. 1*a*-1*d* show a plan view of a known conformation, where a compartment 10 has a front opening that can be closed by two sliding and folding-away leaves 12, 14 (FIG. 1*a*). To uncover the compartment 10 the leaves 12, 14 are moved sideways and rotated about a common vertical hinging axis Q that binds them on the adjacent sides. The Q axis moves away from the compartment (FIG. 1*b*) as the leaves 12, 14 stack on each other (FIG. 1*c*) to be moved then to the side of the compartment (FIG. 1*d*).

The displacement of the leaves 12, 14 is manual and quite difficult to operate because it requires the user to make various movements on the leaves 12, 14: at least one to stack them and one to push them along the side of the compartment. Even if springs are introduced to let the leaves overcome the dead points of the kinematics and to reduce manual efforts, the complexity of the movement remains unchanged.

Improving this state of the art is the main object of the invention, which is defined in the attached claims, wherein the dependent ones define advantageous variants.

Another object is to provide a furniture item, having a compartment that can be closed by sliding and bellows-like folding leaves, which is easy to use, requires few movements for the user and is not tiring during use.

An item of furniture is proposed comprising:

a body defining a compartment with a front opening, a (vertical or horizontal) leaf which is slidable and oscillating to close the front opening, an L-shaped guide comprising two linear segments connected together, wherein a first segment is parallel to an edge of the opening, and a second segment is orthogonal to the first and arranged at an outer side of said body along the depth of the compartment;

a command member which is translatable parallelly to—and along—said outer side; wherein a lateral edge of the leaf is slidably coupled with the guide, and the opposite lateral edge of the leaf is connected in swinging manner to the command member so that an alternate linear motion of the latter moves the leaf into a first position wherein it closes the opening or into a second position wherein the leaf clears the opening and is placed side by side with said outer side.

In other words, the command member is movable between two positions:

a rest position in which it is placed in front of the outer side (flank) and substantially does not protrude frontally therefrom, and a position in which it is offset horizontally with respect to the outer side (and to the compartment) to protrude frontally from the outer side and from the compartment (the translatable command member is moved to the direction of the front opening of the compartment and is moved away from the back of the compartment).

According to a first variant, the furniture item comprises only one leaf. A side of the leaf is slidably coupled with the guide, and the opposite side of the leaf is hinged to the command member about an, e.g. vertical, axis.

According to another variant, the furniture item comprises a first leaf and a second leaf connected in oscillating manner to the first leaf (e.g. hinged to each other).

The first leaf, at its side closest to the second segment, is slidingly coupled to the guide. A side of the second leaf is hinged to the translatable command member about a first axis. The opposite side of the first leaf is hinged, about a second axis, to the second leaf.

When the first leaf is not coupled directly to the guide, it is through the second leaf. However, the translatable command member can thus operate the train of leaves by transmitting kinetic energy to them through an alternate translatory movement of its, a movement that occurs parallelly to the depth of the compartment.

It turns out, then, that in the second variant the leaves are foldable like a bellows about at least one axis, and are sliding between a closing position of the compartment, in which they are arranged coplanar to each other in front of the compartment, and an opening position of the compartment, in which they are folded one on the other and placed along said side or flank of the compartment.

The leaves are conveniently set in motion by means of an alternating displacement of the translatable command member.

In both variants, said outer side of the compartment mat be a side (flank) or a ceiling or a floor. Thus one or more leaves can be hidden next to the compartment, above the compartment or below it. In the first case the L-shaped guide has both segments arranged horizontally; while in the second case the first segment is horizontal and the second segment is vertical. That is to say, that the aforementioned variants with one or two leaves in turn can be implemented by using leaves fitted for moving horizontally or vertically. In the first case the aforementioned axes are vertical, in the second case they are horizontal. Below, for the sake of simplicity, reference will be made to the case of horizontally moving leaves, it being understood that the second case corresponds to the first one mutatis nutandis.

The first hinging axis is supported by the translatable command member so that it can rigidly move horizontally. Then such first axis is movable horizontally between two end-positions: a resting end-position and an advanced end-position (further from the compartment). To an alternative motion of the translatable command member there corresponds both a displacement of the first axis, which always starts from the first end-position, arrives at the second, and returns again to the first; and a movement of the second axis along the guide. This displacement of the second axis along the guide takes place in a direction and then in the opposite one during two successive alternative movements of the translatable command member. At the first end-position, the first axis is substantially arranged coplanar or close to the plane of the front opening: to this configuration there correspond the closing and opening positions of the leaves. In correspondence of the second end-position, the axis is spaced orthogonally from the plane of the front opening: to this configuration there corresponds an intermediate position of the leaves.

Preferably, the furniture item comprises means for rotating the second leaf with respect to the first leaf about the second hinging axis during the movement of the leaves toward the second position. In particular, the means are configured so that said rotation is gradual and synchronized with the translatory movement of one or each leaf. E.g. the furniture item comprises means for rotating the second leaf to/away from the first leaf about the second hinging axis during the movement of the leaves towards the second/first position.

Preferably, the translatable command member comprises a vertical wall mounted translatable on—and relative to—the compartment to slide substantially parallel to the direction that identifies the depth of the compartment. More preferably, the translatable command member comprises two vertical walls arranged orthogonally to each other and mounted movable on—and relative to—the compartment. In a first variant, the two vertical walls are arranged as an L and mounted movable on—and relative to—the compartment to delimit a second compartment or storage area in which the leaves, when packed, are stored. In a second variant, the two vertical walls are arranged like a T and mounted movable on—and relative to—the compartment to close a second compartment or storage area where the leaves, when packed, are stored. This allows covering the leaves when they are not in use, giving shelter to them from dust and avoiding accidental shocks for their mechanisms.

Preferably, the furniture item comprises a return element or means for exerting a force on the translatable command member. The return element or means acts to move the translatable command member towards the rest position, or the first end-position. Thus a user just needs to pull towards himself the translatable command member to move it from the first to the second end position, and the translatable command member will automatically return into position when released, pushed by the return element or means.

Preferably, the furniture item comprises a guide system for the translatable command member. In particular, the driving system comprises a first guide, integral with the frame of the furniture item, which is arranged along the direction of the depth of the furniture item, a second guide, integral with the command member, arranged along the direction of the height of the furniture item, and a member that is mounted to be able to linearly slide simultaneously along the first guide and the second guide when the translatable command member is moved between the two said positions.

More specifically, the driving system comprises as second guide, two parallel bars integral with the frame of the furniture item which are arranged along the direction of the depth of the furniture item, two skids mounted linearly slidable along the guides and coupled slidingly to the translatable command member.

Even more particularly, the two parallel bars are inclined with respect on the horizon and the two skids are coupled to a vertical guide integral with the translatable command member, so as to be able to slide vertically relative to it.

Preferably, the skids comprise a, e.g. magnetic, brake or shock absorber, e.g. to generate a resistant force equivalent to a viscous friction when the skid moves.

To avoid shocks or vibrations, preferably the furniture item comprises a shock absorber to brake the translatable command member when it is ending its travel moving between said rest position and said position in which it is offset horizontally.

To facilitate assembly, a leaf is coupled to said guide by fastening it on a carriage that is mounted sliding on the guide.

Preferably the first segment and the second segment of the guide are connected by a curved junction, to favor the sliding of the carriage and/or the guide.

Preferably the first segment and the second segment of the guide comprise vertical walls, e.g. L-shaped, which delimit two tracks arranged side by side in which are slidable respective wheels rotatably pivoted on the carriage. In particular, the carriage comprises only two wheels, each one engaged in a respective track, which are mounted on the carriage so that the wheel slidable in the innermost track precedes, along the advancement direction, the other wheel. In this way the curve of the L is traveled by the carriage in a more fluid way, and the leaf carried by the carriage is moved outside of the furniture item with a rapid movement as soon as the L-shaped curve is engaged.

Preferably, the translatable command member is an aluminum frame.

A simple and robust construction preferably provides that a vertical wall of the furniture item, which constitutes said side or flank, comprises a recess or an inlet in which the connecting junction is placed and through which the carriage can pass to move from a segment to the other.

The advantages of the invention will be even clearer from the following description of preferred embodiments, referring to the attached drawing in which FIGS. 1*a*-1*d* show schematically in plan view an opening sequence of leaves for a known piece of furniture;

FIGS. 2*a*-2*e* schematically show a cross-section in plan view, according to the plane S of FIG. 3*a*, for an opening sequence of leaves for a piece of furniture according to the invention;

FIGS. 3*a*-3*b* show a three-dimensional view of the furniture item relative to FIGS. 2*a*-2*e;*

FIGS. 4*a*-4*d* show a closing sequence for leaves in plan view;

FIGS. 5*a*-5*d* show a closing sequence for leaves in plan view;

Figure 8B:
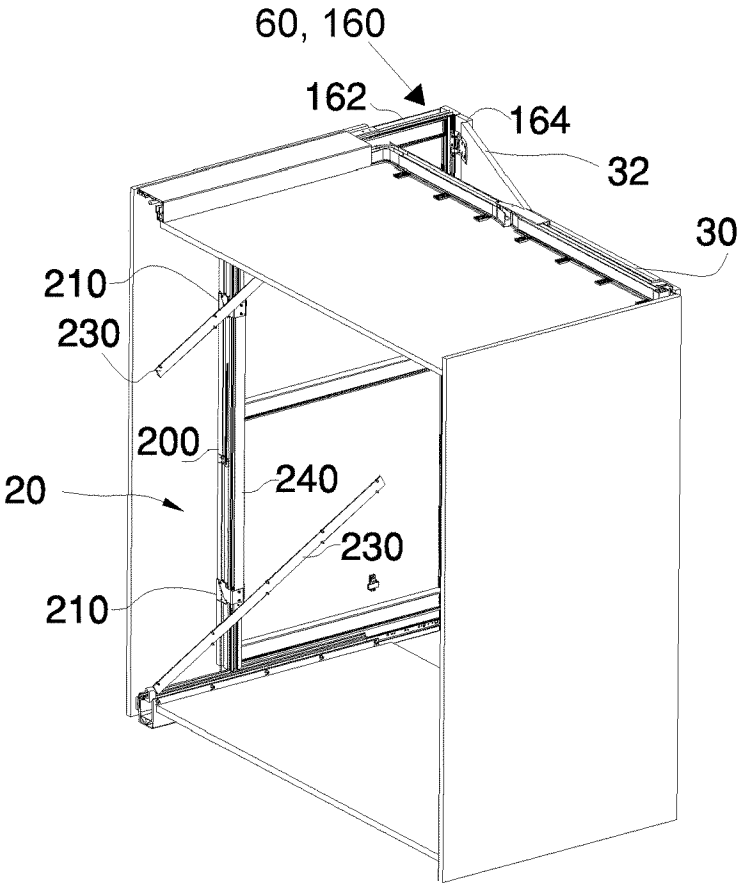
Figure 8A:
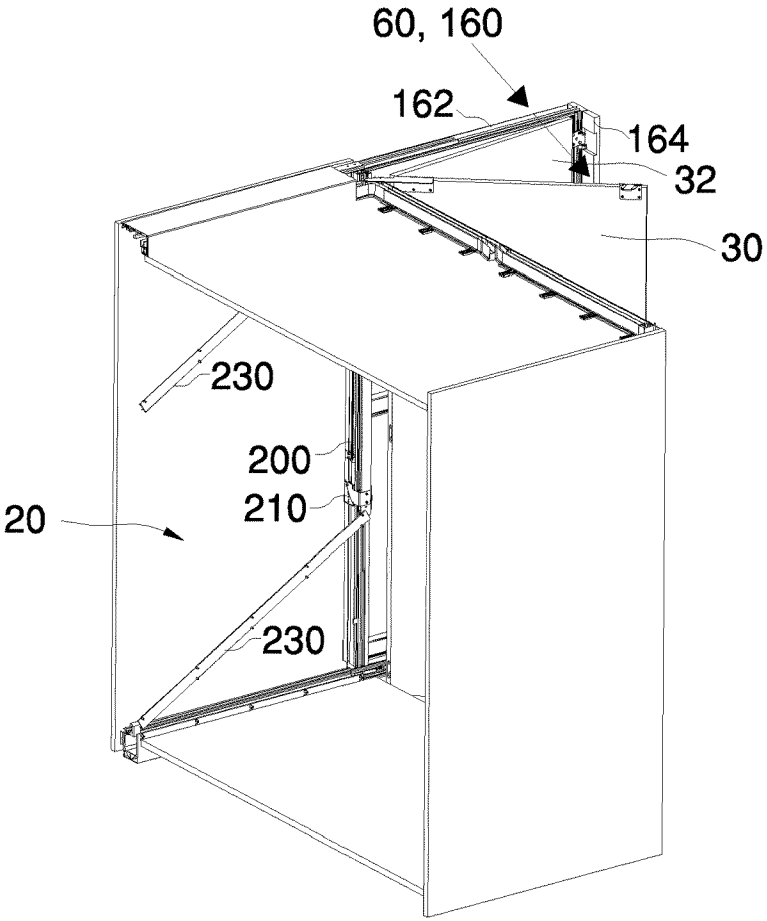

FIGS. 8*a*-8*b* show a three-dimensional view from behind of a variant of furniture item in two different configurations.

In the figures, equal numbers indicate equal or conceptually similar parts, and the elements are described as in use.

A furniture item MC according to the invention comprises a module (FIG. 3*a*, 3*b*) formed by a compartment 20 which defines a space open towards the outside delimited by a bottom 22, a ceiling 24, two side vertical walls 26 spaced apart from each other by the width of the compartment 20, and a rear wall 28.

The compartment 20 forms a frontal span which can be stopped up by two leaves 30, 32 slidable in front of the compartment 20.

Figures 2A, 2B, 2C, 2D, 2E:
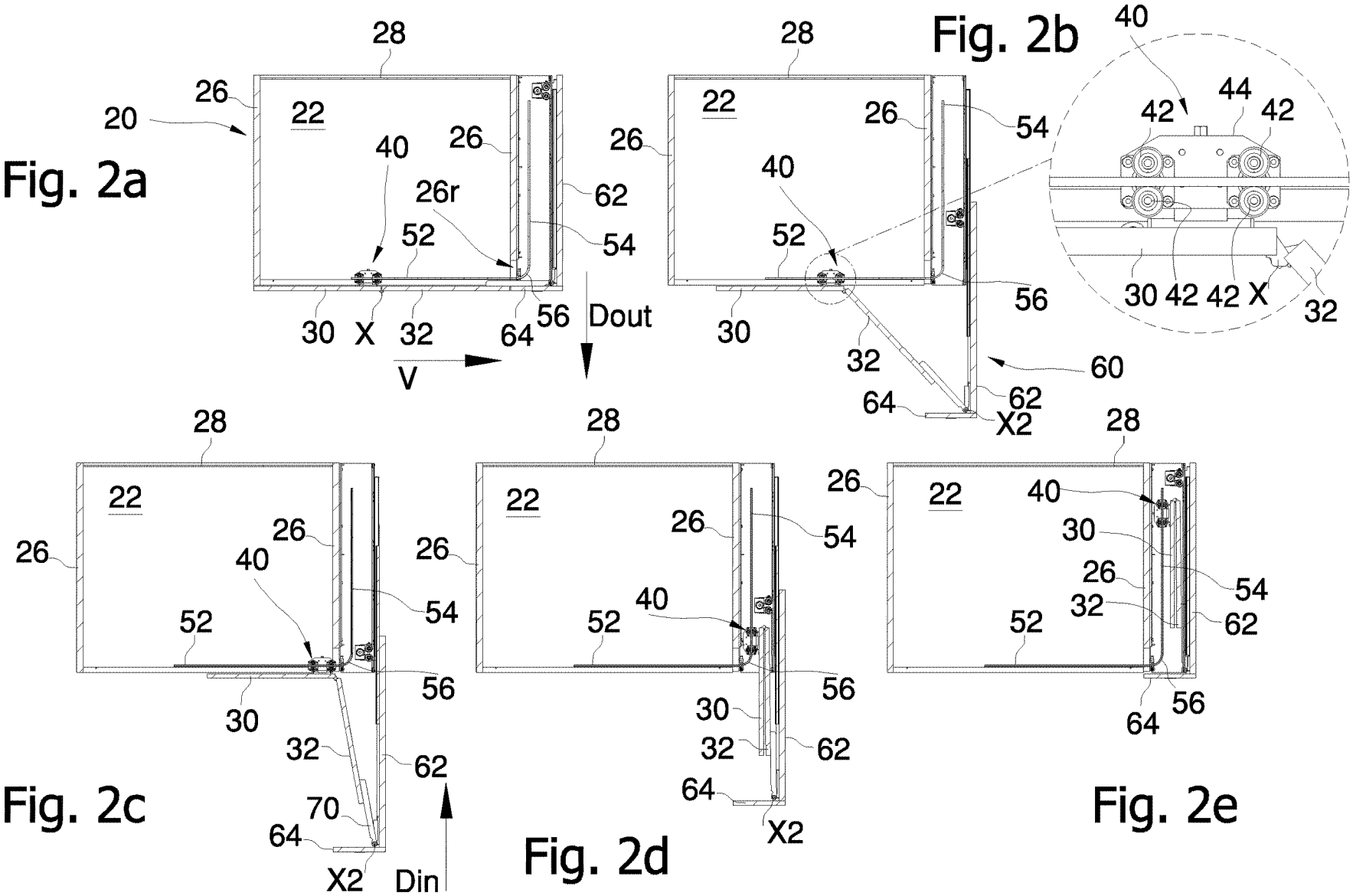

The leaves 30, 32 can move bellows-like in front of the compartment 20 to close it or to leave it accessible from the outside. During the movement, the leaves 30, 32 always remain vertical and vary their relative position and that with respect to the compartment 20. When the compartment 20 is closed, the leaves 30, 32 are adjacent to each other and coplanar (FIG. 2*a*), while to uncover the compartment 20, the leaves 30, 32 are movable to be stacked on each other at one side of the compartment 20 (FIG. 2*d*-2*e*).

We indicate conventionally by 30 the most distant leaf from the side of the compartment 20 in which the leaves 30, 32 can be stacked, while by 32 the leaf closest to such side.

The adjacent sides (the closest to each other) of the leaves 30, 32 are hinged together about a vertical hinging axis X. Or the leaf 32 may be hinged to the carriage 40.

The leaf 30 is supported only by a carriage 40 which is movable for sliding horizontally and sideways to the compartment 20.

The movable carriage 40 comprises e.g. (see enlargement of FIG. 2*b*) a plate 44 on which there are mounted—according to the vertices of a rectangle—four wheels 42 engaged on an L-shaped planar guide which the carriage 40 can travel back and forth. For stability, the wheels 42 are e.g. arranged in pairs on opposite sides of the guide.

The guide comprises two straight segments 52, 54 which are horizontal and orthogonal to each other.

The first segment 52 is parallel to—and flush with—the front edge of the compartment 20 (or, similarly, to the plane on which the leaves 30, 32 arrange themselves coplanar and side by side). The second segment 54 is orthogonal to the front edge of the compartment 20 (or, similarly, orthogonal to the plane on which the leaves 30, 32 are placed side by side). The segment 54 is mounted parallel, adjacent and externally to one of the two walls 26. The segment 52 and the segment 54 are connected by a junction 56, preferably curved or cranked.

The segment 52 is preferably fixed to the ceiling 24, and in such a way as to remain slightly inside the outer edge of the compartment 20. The second segment 54 is fixed to the outside of a side wall 26, which comprises a recess 26*r* to allow the assembly of the junction 56 and the passage of the carriage 40 from one linear segment to the other. If the L-shaped guide is mounted above the ceiling 24, the recess 26*r* may be omitted.

For greater stability, preferably also the base of the leaf 30 is guided by a carriage equal to the carriage 40, and the two carriages can be moved in a synchronized way. However, other variants are possible, wherein for example there is only or also one carriage similar to the carriage 40 placed at half height of the leaf 30.

The leaf 30 is coupled to the carriage 40 at its own vertical edge hinged to the other leaf 32, i.e. it is the edge of the leaf 30 facing the segment 54 which is fixed to the carriage 40.

By what has been mentioned above and with the convention used, the leaf 30 is the only one mounted on the carriage 40 and the leaf 32 is the one closest to the segment 54 when the leaves 30, 32 are coplanar.

To simplify the movement of the leaves 30, 32, the furniture item MC comprises a movable frame or flank or member 60 (see FIG. 2*b*), which is linearly translatable—see the translation directions indicated with Din and Dout—along a direction parallel to the wall 26 (or in other words parallel to the segment 54 or orthogonal to the wall 28). The movable frame or flank or member 60 is linearly translatable e.g. by means of linear guides mounted on the side of the compartment or other known means, e.g. through skids.

In FIGS. 2*a*-2*e* and 3*a*-3*b* the member 60 is shown in the variant of a movable side of the furniture item MC, with an L-shaped cross-section when seen in plan view to delimit, with an adjacent wall 26, a storage compartment for the leaves 30, 32 when they are packed. According to this preferred variant, the member 60 comprises a vertical lateral wall 62, about the same size as a wall 26, and a front wall 64, orthogonal to the wall 62 and parallel to the wall 28.

Figure 3B:
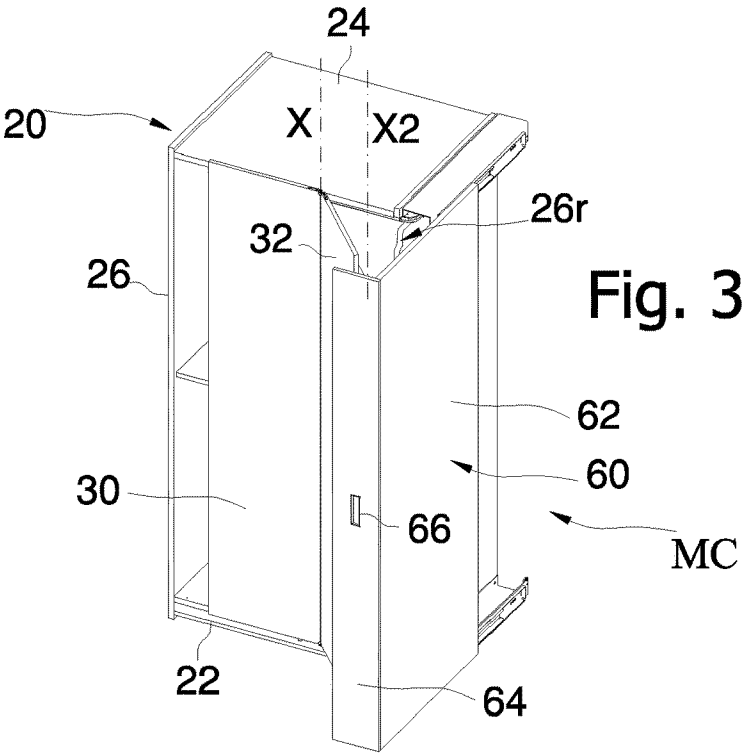
Figure 3A:
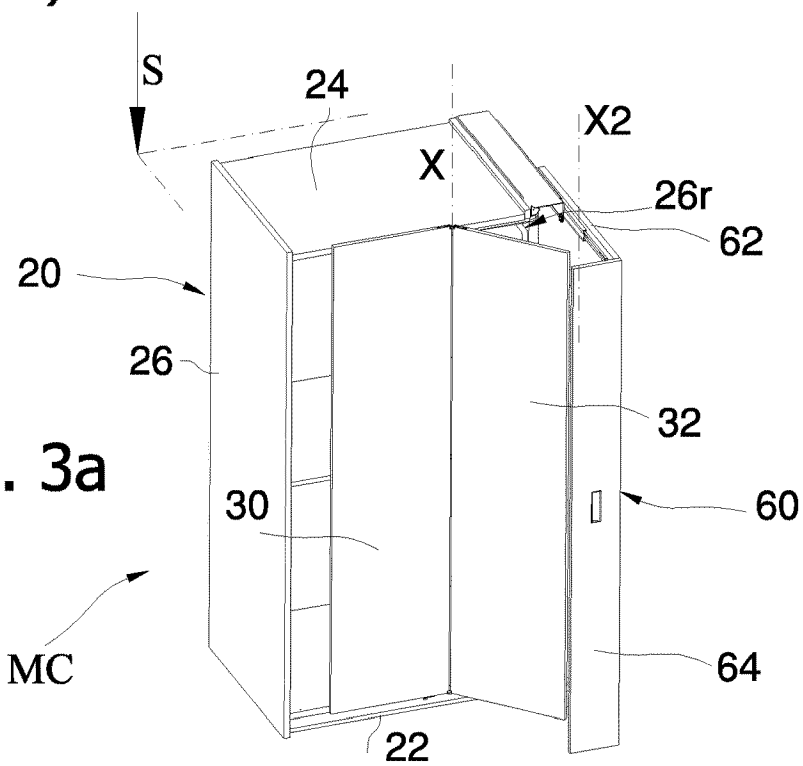

The end of the leaf 32 opposite the axis X is hinged to the member 60 about a vertical axis X2 (FIGS. 2*c* and 3*a*-3*b*). If necessary, there is a connecting spacer 70, to compensate for too narrow a leaf 32 with respect to the depth of wall 62. The element 70 may also be an arm of the hinge which causes the leaves 30, 32 and the front wall 64 to be planar when the compartment is closed.

Thanks to the construction described above, the leaves 30, 32 can then be moved in front of the compartment 20 by actuation of the member 60, which avoids moving the leaves 30, 32 by hand in a difficult way or by other means.

The coupling between the leaf 32 and the member 60 is advantageous because the user just needs to move the member 60 back and forth (e.g. via a handle 66) to move together the leaves 30, 32, from being coplanar (FIG. 2*a*) to being packed and hidden (FIG. 2*e*), or vice versa. This simplifies the displacement operations for the leaves 30, 32.

The member 60 is translatable back and forth (directions Din and Dout) parallelly to the vertical wall 26 which mounts the segment 54, so that the front wall 64 is laid on the front edge of the wall 26 (FIG. 2*e*) to end up coplanar to the leaves 30, 32 when the compartment 20 is closed by them.

Refer to the sequence of configurations shown in FIGS. 2-2*e*.

FIGS. 3*a*-3*b* illustrate three-dimensionally the configuration of the furniture item MC of FIG. 2*b*.

In FIG. 2*a* the leaves 30, 32 are coplanar and adjacent to each other, to close the compartment 20. Now the carriage 40 is on the segment 52 at the end of the stroke.

To uncover the compartment 20, the member 60 is gradually extracted away from the compartment 20, that is, traction of the member 60 is sufficient to extract it (Dout direction) from the item MC (movement towards the user, i.e. recession from the rear wall 28). This displacement of the member 60 imparts to the leaf 30, through the leaf 32, an impulse. The leaf 30 then moves towards the segment 54 (on the right in FIG. 2*a*), and the carriage 40 moves on the segment 52 (FIG. 2*b*) towards the junction 56, determining a horizontal translation of the leaf 30 towards the segment 54 (direction V in FIG. 2*a*). Meanwhile, the leaf 32 rotates about the X axis to move its vertical edge hinged to the member 60 away from the compartment 20 and to approach and overlap the leaf 30. As the carriage 40 moves on the segment 52 (FIG. 2*c*) until it reaches the junction 56, the leaf 32 continues to rotate about the axis X towards the leaf 30.

The initial motion impulse given by the member 60 not only sets the leaf 30 in motion along the guide but gives it enough kinetic energy to push the carriage 40, which carries the leaf 32, up to the junction 56 (FIG. 2*c*) and to go beyond it by inertia (FIG. 2*d*).

When the junction 56 is reached, the carriage 40 runs through it, passes it and starts to move on the segment 54 (FIG. 2*d*). During the curve on the junction 56 the leaf 30, integral with the carriage 40, rotates towards the leaf 32 until it becomes orthogonal to its own initial position of FIG. 2*a*. Meanwhile, the leaf 32 has flattened against the wall 62 of the member 60.

At this point (FIG. 2*d*) the leaves 30, 32 are packed on each other and a slight push on the member 60 (direction Din) is sufficient, bringing it back inside the item MC (displacement towards the rear wall 28), to terminate the travel of the carriage 40 beyond the junction 56 (FIG. 2*e*). During this final run, the carriage 40 moves tangentially and parallel to the wall 26, towards the rear wall 28.

The carriage 40 continues to travel on the segment 54 (FIG. 2*e*) up to the end-position opposite the junction 56. In the final position, the leaves 30, 32 are packed on each other and both located laterally to the compartment 20, outside the wall 26 which mounts the segment 54.

To cover the compartment, the member 60 is re-extracted and the movements of the leaves 30, 32 repeated with inverted order.

The aforementioned opening or closing operations are not tiring for the user, and the movement of the leaves 30, 32 takes place almost automatically. In both cases of opening or closing the compartment 20, to start the motion of the leaves 30, 32 just a pull of the member 60 is enough to extract it (Dout direction) from the item MC (shift towards the user, i.e. departure from the rear wall 28). This displacement of the member 60 imparts to the leaf 30, through the leaf 32, an impulse that not only sets it in motion along the guide but gives it enough kinetic energy to push the carriage 40 up to the junction 56 (FIG. 2*c*) and go beyond it by inertia (FIG. 2*d*), and this holds for the two opposite traveling directions on the L-shaped guide. A slight push on the member 60 is then enough (direction Din), bringing it back into the item MC (moving towards the rear wall 28), to terminate the travel of the carriage 40 beyond the junction 56 (FIG. 2*a* or FIG. 2*e*).

Therefore the accelerated mass of the leaf 30 constitutes a sort of flywheel which allows the carriage 40 to travel along the junction 56 avoiding a dead point (intermediate configuration between about FIGS. 2*c* and 2*d*) in which a thrust on the member 60 towards the compartment 20 (see direction Din in FIG. 2*c*) either does not produce an effect on the leaves 30, 32 or is likely to stall them.

Preferably, the item MC comprises a return means for the member 60 (e.g. a spring or counterweight) to return the member 60 towards the wall 28 (direction Din). In this way the user is only required to pull towards himself the member 60 until the carriage 40 has passed or entered the junction 56; after which the member 60 can be released and it will end its run, together with the leaves 30, 32, driven by the return means.

Preferably, the item MC comprises a shock absorber for braking gently the member 60 when it is terminating its travel in the direction Din. In this way, collisions at the end-positions and too fast jerks are prevented.

Figure 1D:
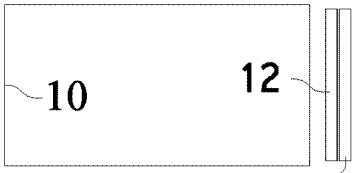
Fig. 1d (Prior art)
Figure 1C:
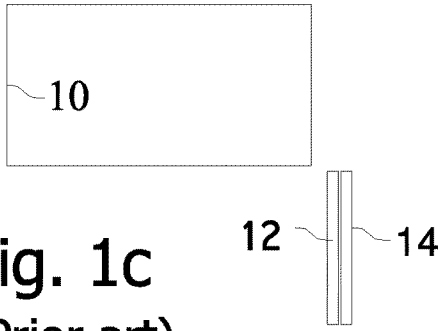
Fig. 1c (Prior art)
Figure 1B:
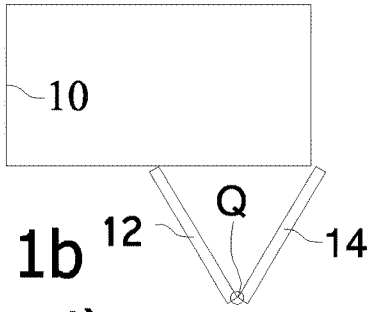
Fig. 1b (Prior art)
Figure 1A:
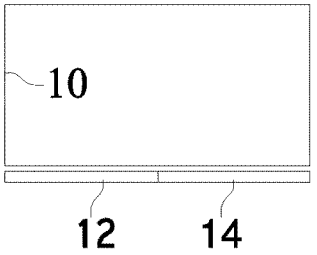
Fig. 1a (Prior art)

The furniture MC may also comprise a third leaf, to be connected at the tail end of the leaf 30 to form a bellows such as the leaves 12, 14 of FIGS. 1*a*-1*c*.

A piece of furniture according to the invention may also have only one leaf, such as illustrated in the variant of item MC2 of FIGS. 4*a*-4*d*. The structure of the member 60, of the carriage 40 and of the L-shaped guide, is the same as the previous one.

Figures 4A, 4B, 4C, 4D, 5A, 5B, 5C, 5D:
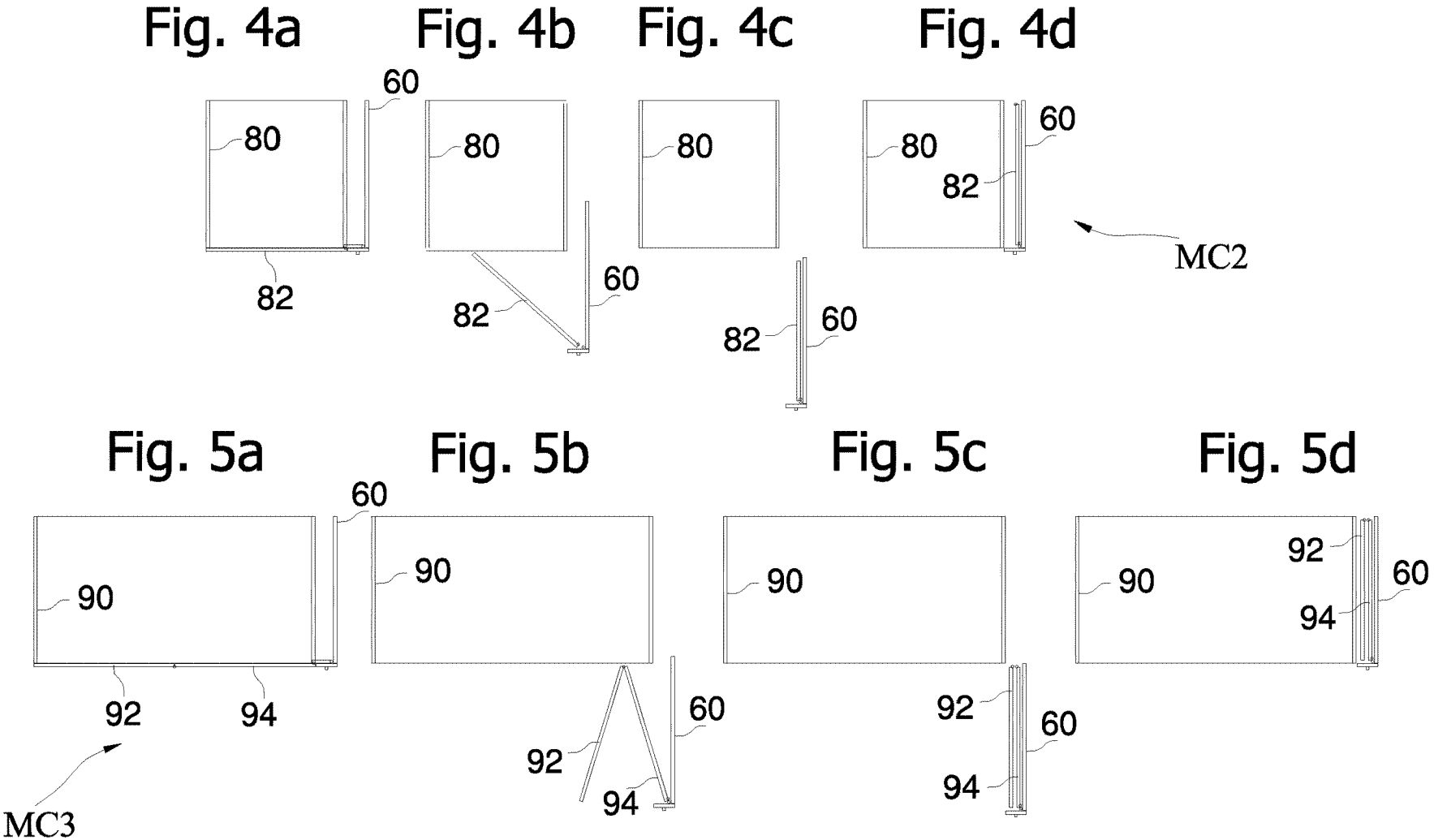

A compartment 80 has a front opening which can be closed by a single sliding leaf 82 (FIG. 4*a*). The leaf 82 has a side hinged to the member 60 (like the leaf 32) and the opposite side is supported by—and hinged to—the carriage 40 (not shown here).

To uncover the compartment 80, as before, first the member 60 is pulled so that the sliding edge of the leaf 82 runs along the segments 52, 54 (FIG. 4*b*), until the leaf 82 flattens out on the member 60 and becomes orthogonal to its original position (FIG. 4*c*). Then the member 60 is pushed towards the inside of the item MC2 to hide the leaf 82 (FIG. 4*d*), which ends its stroke on the segment 54 and ends up parallel to the side of the cabinet MC2.

A piece of furniture according to the invention e.g. may have means to pack automatically the leaves, as illustrated in the variant MC3 of FIGS. 5*a*-5*d*. The structure of the member 60, of the carriage 40 and of the L-shaped guide is e.g. equal to the previous one.

Here a compartment 90 has a front opening that can be closed by two sliding leaves 92, 94 (FIG. 5*a*). The leaves 92, 94 are connected respectively as the leaves 30, 32 of the item MC, with the addition of a mechanism that, during the packing of the leaves 92, 94 (FIG. 5*b*), imparts a torque to the leaf 90 to make it rotate about the X axis towards the leaf 94.

Thus the leaves 92, 94 are already overlapped and coplanar (FIG. 5*c*) before placing them beside the compartment (FIG. 5*d*). Another advantage lies in the fact that when the carriage has not yet passed the dead point, the compartment is more open.

This mechanism can be implemented e.g. with a synchronized hinge, (i.e. a hinge that synchronizes the angular opening of its rotating parts), or with a spring mounted on the X axis to generate the torque.

The mechanism preferably operates to rotate the leaf 90 in opposite direction during the closing phase of the compartment.

The mechanism and furniture items MC, MC2 or MC3 are open to many variants. The furniture item MC4 of FIG. 6 and following shows some of them, usable alone or by combining them in one or each variant MC, MC2 or MC3.

The leaf 30 is supported by a different carriage, indicated with 140, movable for sliding horizontally and sideways to the compartment 20. The connection between the leaf 30 and the leaf 32 is unaltered with respect to e.g. FIG. 3*a*.

The movable carriage 140 e.g. comprises (see enlargement of FIG. 6) a plate 144 on which two wheels 142*a*, 142*b* are pivoted vertically to rotate about a respective vertical axis X7 (parallel to X and/or X2).

The wheels 142*a, b* are—as before—engaged and sliding on an L-shaped planar guide that the carriage 140 can travel on back and forth. The guide comprises two straight sections 152, 154 which are horizontal, orthogonal to each other and connected by a curved elbow-shaped segment. Sections 152, 154 are functionally similar to the segments 52, 54.

The axes X7 of the wheels 142*a, b* are contained in parallel vertical planes which are slightly offset. Therefore one of the wheels 142*a, b*, the one that runs on the innermost track, is, with respect to the other wheel, closer to the rear wall 28 and closer to the section 154 too. The wheels 142*a, b* slide inside a respective track to move the leaves. The relative arrangement on the carriage 140 of the wheels 142*a, b* is advantageous because when they reach the curved junction of the sections 152, 154, the carriage 140 is rotated towards the outside carrying the leaf 30 with it.

In this variant, the sections 152, 154 consist of two tracks placed side by side, inside which the wheels 142*a, b* can be slide in guided manner. E.g. the tracks may be made up of three L-shaped vertical septa 199 arranged side by side.

Figures 6, 7:
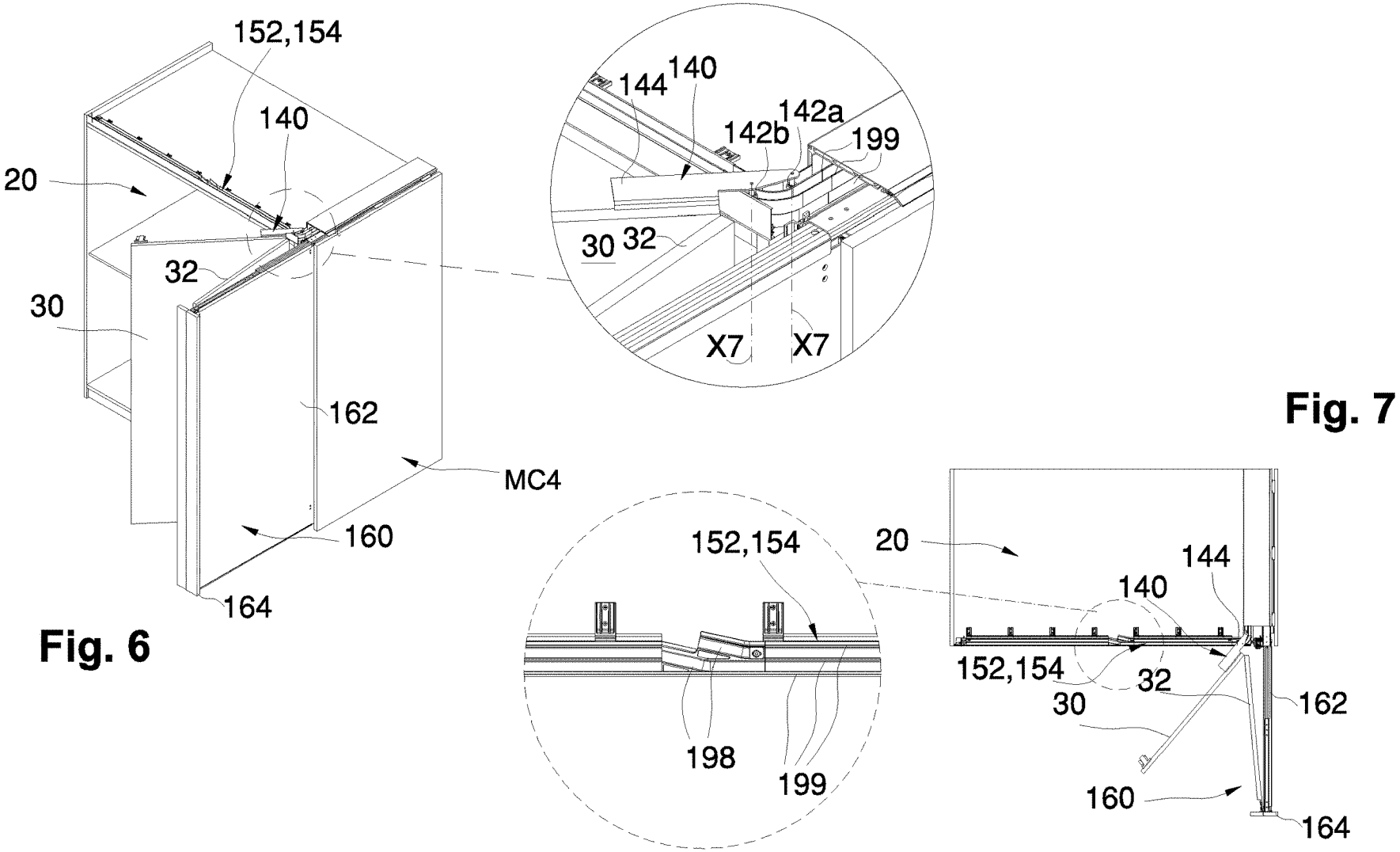
FIG. 6 shows a three-dimensional view for a variant of furniture item.
FIG. 7 shows a plan view of a variant of a furniture item.

Notice how another preferred variant, see FIG. 7, may envisage that the initial part of the tracks for the wheels 142*a, b* comprises a curve 198, in correspondence of the position of the closed leaf 30. The curve 198 deviates slightly the orientation of the tracks towards the rear wall 28, thus the carriage 140, at the end-position where the leaves 30, 32 cover the compartment 20, is pushed to go back slightly towards the rear wall 28, thereby making the leaf 30 translate towards the compartment 20. Thus, the leaf 30, which while sliding is slightly spaced from the furniture item to slide without obstacles, is adhered to the frame of the piece of furniture for a better closure.

The frame or flank or movable member 60 (see FIG. 6) may also have a different structure. The variant of frame or sidewall or movable element is indicated with 160, and is linearly translatable as previously described. Its shape changes, though, in the new example consisting of a vertical side wall 162, of approximately dimensions equal to a wall 26, and a front wall 164, orthogonal to the wall 62 and parallel to the wall 28. The front wall 164 and the wall 162 form in cross-section a T, i.e. the front wall 164 is attached to a vertical edge of the wall 162 in correspondence of an imaginary midpoint line. The front wall 164 may also be formed of two or more coplanar panels.

The coupling between the command member, e.g. like the one indicated with 60 or 160, and the rest of the furniture may vary, while maintaining the same general operation already described.

E.g. FIGS. 8*a*, 8*b* illustrate a different way to slidingly support the translation of the member 60 or 160.

The command member, made e.g. as the member 60 or 160, is integral with a vertical guide 200 in which two skids 210 are linearly slidable. E.g. the skids 210 comprise a, e.g. magnetic, damper to make the movement of the skid 210 on the guide 200 fluid.

Each skid 210 is rigidly bound to the other skid, e.g. through a bar 240, and is slidably constrained to a respective straight bar 230 integral with the frame of the piece of furniture and mounted on the outside of the sidewall 26. The two bars 230 are parallel, spaced from each other and preferably inclined with respect to the horizon.

The bar 240 is horizontally sliding without detachment along the bars 230, and simultaneously sliding vertically on the guide 200 thanks to the skids 210.

When the member 60 or 160 moves back and forth (motion Dout and Din) for moving the leaves 30, 32, the sliding skids 210 run along the bars 230, and as a consequence they go up or down in unison along the guide 200. In this way the movement of the member 60 or 160 is stabilized to avoid jamming or vibrations.

Preferably, there is an elastic element mounted between a skid 210 and a fixed point of the furniture frame, e.g. a spring. The elastic element is mounted so as to generate an elastic force to push or pull the skids 210 towards a rest position corresponding to one or each of the end-positions of the member 60 or 160 (i.e. inserted inside the frame of the furniture item or extracted completely from the frame). This elastic element serves to facilitate and/or assist the movement of the member 60 or 160.

The invention claimed is:

1. Item of furniture comprising:

a body defining a compartment with a front opening, a first and second leaf which are slidable and oscillating to close the front opening, an L-shaped guide comprising two linear segments connected together, wherein a first segment is parallel to an edge of the opening, and a second segment is orthogonal to the first segment and arranged at an outer side of said body along the depth of the compartment;

a command member translatable parallelly to—and along—said outer side; wherein the second leaf is connected in oscillating manner to the first leaf;

a side of the second leaf is hinged to the command member about a first vertical axis, a side of the first leaf, which side is closest to the second leaf, is slidably coupled to the guide;

said side of the second leaf being connected in swinging manner to the command member so that an alternate linear motion of the latter moves the leaves into a first position wherein they close the opening or into a second position wherein the leaves clear the opening and are placed side by side with said outer side.

2. Item according to claim 1, wherein the first leaf, at said side closest to the second leaf, is hinged about a second vertical axis to the second leaf.

3. Item according to claim 1, comprising means for rotating the second leaf with respect to the first leaf about the first vertical axis during the movement of the leaves toward the second position.

4. Item according to claim 1, wherein the translatable command member comprises a carriage mounted movable along a slide rail connected to said outer side.

5. Item according to claim 4, wherein the carriage supports two vertical walls arranged as an L-shape and mounted movably on—and with respect to—the compartment for delimiting a second compartment or storage in which the leaves, when folded, are stored.

6. Item according to claim 1, comprising a return element or means for exerting a force on the translatable command member to move it to a rest position.

7. Item according to claim 1, comprising a shock absorber for braking the command member when it is ending its stroke.

8. Item according to claim 1, wherein the first leaf is coupled to said guide by fixing it to a carriage which is slidably mounted on the L-shaped guide.

9. Item according to claim 1, wherein the first segment and the second segment of the guide are connected by a curved portion and lie on a horizontal plane.

10. Item according to claim 1, wherein the command member comprises a vertical wall mounted translatable on—and relative to—the compartment to slide substantially parallel to a direction that identifies the depth of the compartment.

11. Item according to claim 10, wherein the command member comprises two vertical walls arranged orthogonally to each other and mounted movable on—and relative to—the compartment.

12. Item according to claim 11, wherein the two vertical walls are arranged as an L and mounted movable on—and relative to—the compartment to delimit a second compartment or storage area in which the leaves, when packed, are stored.

13. Item according to claim 11, wherein the two vertical walls are arranged like a T and mounted movable on—and relative to—the compartment to close a second compartment or storage area where the leaves, when packed, are stored.

14. Item according to claim 1, comprising a guide system for the translatable command member.

15. Item according to claim 1, comprising a driving system for the translatable command member, the driving system comprising a first guide, integral with a frame of the furniture item, which is arranged along a direction of the depth of the furniture item, a second guide, integral with the command member, arranged along a direction of the height of the furniture item, and a member that is mounted to be able to linearly slide simultaneously along the first guide and the second guide when the translatable command member is moved between the two said positions.

16. Item according to claim 15, wherein the driving system comprises as second guide, two parallel bars integral with the frame of the furniture item which are arranged along a direction of the depth of the furniture item, two skids mounted linearly slidable along said guides and coupled slidingly to the translatable command member.

17. Item of furniture comprising:

a body defining a compartment with a front opening, a leaf which is slidable and oscillating to close the front opening, an L-shaped guide comprising two linear segments connected together, wherein a first segment is parallel to an edge of the opening, and a second segment is orthogonal to the first and arranged at an outer side of said body along the depth of the compartment;

a command member translatable parallelly to—and along—said outer side; wherein a lateral edge of the leaf is coupled slidably with the guide, and the opposite lateral edge of the leaf is connected in swinging manner to the command member so that an alternate linear motion of the latter moves the leaf into a first position wherein it closes the opening or into a second position wherein the leaf clears the opening and is placed side by side with said outer side, a return element or means for exerting a force on the translatable command member to move it to a rest position.

18. Item according to claim 17, comprising a shock absorber for braking the command member when it is ending its stroke.

19. Item according to claim 17, wherein a leaf is coupled to said guide by fixing it to a carriage which is slidably mounted on the L-shaped guide.

20. Item according to claim 17, wherein the first segment and the second segment of the guide are connected by a curved portion and lie on a horizontal plane.

* * * * *